US006524074B2

(12) United States Patent
Farrar et al.

(10) Patent No.: US 6,524,074 B2
(45) Date of Patent: Feb. 25, 2003

(54) GAS TURBINE ENGINE BLADE

(75) Inventors: Peter G G Farrar, Derby (GB); Christopher Freeman, Nottingham (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/901,076

(22) Filed: Jul. 10, 2001

(65) Prior Publication Data

US 2002/0012587 A1 Jan. 31, 2002

(30) Foreign Application Priority Data

Jul. 27, 2000 (GB) ..... 0018316

(51) Int. Cl.[7] ..... F01D 5/14
(52) U.S. Cl. ..... 416/229 R; 416/229 A
(58) Field of Search ..... 416/229 R, 229 A, 416/236 R, 241 R

(56) References Cited

U.S. PATENT DOCUMENTS

| | | | | | |
|---|---|---|---|---|---|
| 2,642,263 | A | * | 6/1953 | Thorp, II | 416/220 R |
| 3,892,612 | A | * | 7/1975 | Carlson et al. | 156/150 |
| 4,342,542 | A | | 8/1982 | Tan | |
| 5,141,400 | A | * | 8/1992 | Murphy et al. | 416/204 A |
| 5,486,096 | A | * | 1/1996 | Hertel et al. | 416/224 |
| 5,573,604 | A | | 11/1996 | Gerdes | |
| 5,756,965 | A | | 5/1998 | Mannava | |
| 6,132,857 | A | * | 10/2000 | Champenois et al. | 416/224 |

FOREIGN PATENT DOCUMENTS

| | | | |
|---|---|---|---|
| DE | 3 821 005 | A | 12/1989 |
| EP | 0 605 152 | A | 7/1994 |
| EP | 0674020 | A | 9/1995 |
| GB | 548 414 | SP | 10/1942 |
| GB | 591 029 | SP | 8/1947 |
| GB | 997 852 | SP | 7/1965 |
| GB | 2 147 055 | A | 5/1985 |
| GB | 2 288 441 | A | 10/1995 |
| JP | 55069796 | AB | 5/1980 |
| JP | 10280907 | AB | 10/1998 |

OTHER PUBLICATIONS

Vibration Damping; Nashif, Jones & Henderson; John Wiley & Sons, 1985; pp263–281.

A. E. Clark, "Magnetostrictive rare earth —Fe2 compounds" Ferromagnetic Materials, vol. 1, ch. 7 North Holland Publishing Co., 1980.

Anjanappa, Magnetostrictive particulate actuators; configuration, modeling and characterization; IOP Publishing Ltd, 1997, pp 393–402.

Sandlund, Magentostriction, elastic moduli, coupling factors of composite Terfenal–D; J. Appl Physic, vol. 75, May 15, 1994, pp 5656–5658.

Anjanappa; Magnetostictive mini actutors for smart structure applications; IOP Publishing Ltd, 1994, pp383.

Agnes; Nonlinear piezoelectric vibration absorbers; IOP Publishing Ltd, 1996; p 704–714.

Bhattacharya; Vibration Suppression of Slender Composite Beams using Magnetostrictive Actuation; Journal of Aero. Soc. Of India; 1996; pp 137–146.

* cited by examiner

*Primary Examiner*—Ninh Nguyen
(74) *Attorney, Agent, or Firm*—W. Warren Taltavull; Manelli Denison & Selter PLLC

(57) ABSTRACT

A gas turbine engine fan blade (26) comprises a root portion (36) and an aerofoil portion (32). The aerofoil portion (32) has a convex surface (44), a concave surface (42), a leading edge (38) and a trailing edge (40). The leading edge (38) of the aerofoil portion (32) is formed from a harder material than the regions of the concave surface (42) and convex surface (44) immediately adjacent the leading edge (38) such that the leading edge (38) of the aerofoil portion (32) remains pointed. This improves the efficiency of the fan blade (26) and hence the gas turbine engine (10) and reduces flutter of the fan blade (10).

17 Claims, 2 Drawing Sheets

GAS TURBINE ENGINE BLADE

FIELD OF THE INVENTION

The present invention relates to a blade for a gas turbine engine, particularly to fan blades, or compressor blades, of gas turbine engines.

BACKGROUND OF THE INVENTION

One problem with fan blades of gas turbine engines is that the leading end of the aerofoil portion of the fan blades suffers from erosion due to impact from foreign objects drawn into the intake of the gas turbine engine. The erosion of the leading end of the aerofoil portion of the fan blade results in blunting of the leading end of the aerofoil of the fan blade and a consequential loss of efficiency of the fan blade.

It is known in the prior art to reduce erosion of gas turbine blades by providing an erosion resistant coating on the surface of the blades, for example our published European patent application EP0674020A, published Sep. 27, 1995. However, the application of an erosion resistant coating results in blunting of the leading end of the aerofoil of the fan blade and a consequential loss of efficiency of the fan blade.

SUMMARY OF THE INVENTION

Accordingly the present invention seeks to provide a novel blade for a gas turbine engine which overcomes the above mentioned problems.

Accordingly the present invention provides a gas turbine engine blade comprising an aerofoil portion having a convex surface, a concave surface, a leading end and a trailing end, the leading end comprising a leading edge arranged between a first leading end portion and a second leading end portion, the first leading end portion being arranged on the convex surface side of the aerofoil portion and the second leading end portion being arranged on the concave surface side of the aerofoil portion, the leading edge being formed of a harder material than the material of the first and second leading end portions such that the leading end of the aerofoil portion retains a taper from the first and second leading end portions to a relatively sharp leading edge.

Preferably the blade is a fan blade or a compressor blade.

Preferably the fan blade comprises at least three sheets diffusion bonded together, at least one of the sheets defining the convex surface, at least one of the sheets defining the concave surface and at least one of the sheets forming a corrugated structure between the convex surface and the concave surface and extending to the leading end of the aerofoil portion.

Preferably the at least one sheet forming a corrugated structure between the convex surface and the concave surface and extending to the leading end of the aerofoil portion being formed of a harder material than the at least one sheet defining the convex surface and the at least one sheet defining the concave surface.

Preferably the at least three sheets are formed of titanium alloy.

Preferably the at least one sheet forming a corrugated structure between the convex surface and the concave surface and extending to the leading end of the aerofoil portion being formed of a harder titanium alloy than the at least one sheet defining the convex surface and the at least one sheet defining the concave surface.

Alternatively the at least three sheets may be formed of the same titanium alloy, the at least one sheet forming a corrugated structure between the convex surface and the concave surface and extending to the leading end of the aerofoil portion being formed of a hardened titanium alloy and the at least one sheet defining the convex surface and the at least one sheet defining the concave surface being formed of unhardened titanium alloy.

Alternatively the at least one sheet forming a corrugated structure between the convex surface and the concave surface and extending to the leading end of the aerofoil portion being formed of a harder alloy than the at least one sheet defining the convex surface and the at least one sheet defining the con cave surface, the at least one sheet defining the convex surface and the at least one sheet defining the concave surface being formed of titanium alloy.

Preferably the at least one sheet forming the corrugated structure between the convex surface and the concave surface and extending to the leading end of the aerofoil portion extending beyond the at least one sheet defining the convex surface and the at least one sheet defining the concave surface.

Alternatively a strip of material may be positioned between the at least one sheet forming the convex surface and the at least one sheet forming the concave surface, the strip of material being formed of a harder material than the at least three sheets.

Alternatively a strip of material may be positioned at the leading end of the aerofoil portion, the strip of material being formed of a harder material than the at least three sheets.

The strip of material may extend beyond the leading end of the aerofoil.

The strip of material may be located in a slot at the leading end of the blade.

The strip of material may be welded, diffusion bonded or brazed in the slot.

BRIEF DESCRIPTION OF THE DRAWINGS

The present invention will be more fully described by way of example with reference to the accompanying drawings in which.

DETAILED DESCRIPTION OF THE INVENTION

Figure 1:
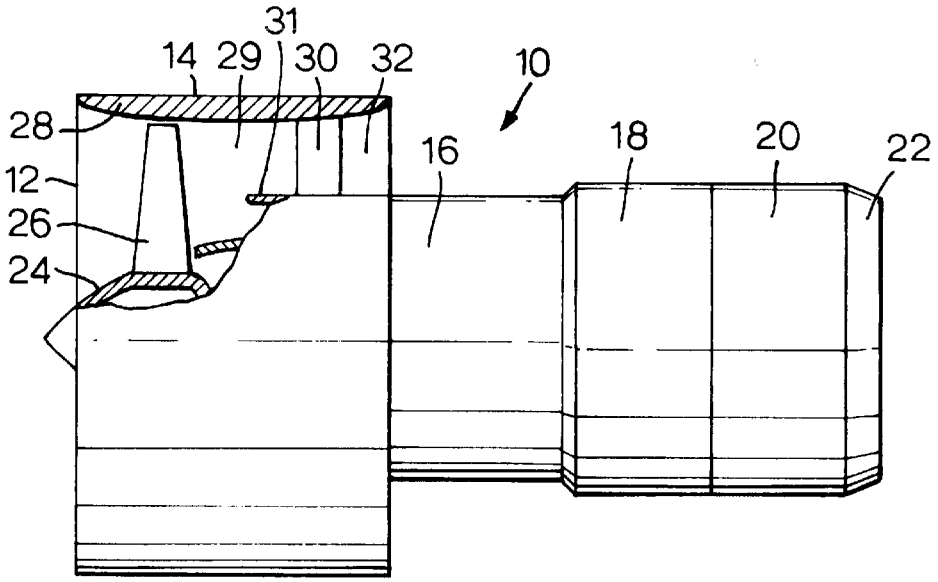
FIG. 1 shows a gas turbine engine comprising a fan blade according to the present invention.
Figure 2:
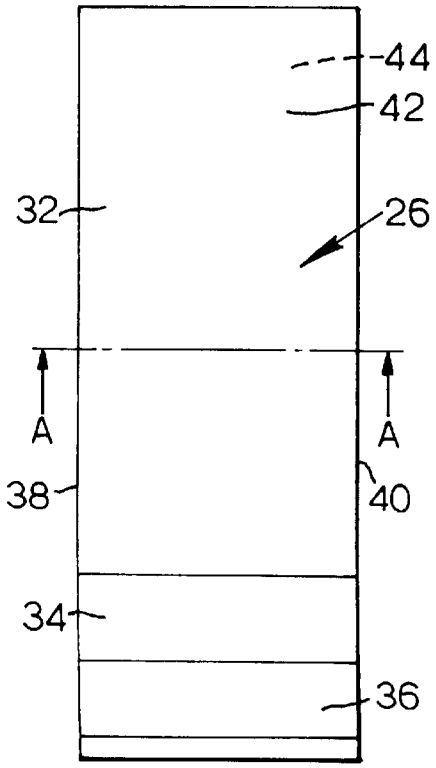
FIG. 2 is an enlarged view of the fan blade shown in FIG. 1.

A turbofan gas turbine engine 10, as shown in FIG. 1, comprises in axial flow series an air intake 12, a fan section 14, a compressor section 16, a combustion section 18, a turbine section 20 and an exhaust 22. The turbine section 20 is arranged to drive the fan section 14 and the compressor section 16 via one or more shafts (not shown). The turbine section 20 may comprise a high pressure turbine, an intermediate pressure turbine and a low pressure turbine to drive a high pressure compressor, an intermediate pressure compressor in the compressor section 16 and a fan in the fan section 14 respectively. Alternatively the turbine section 20 may comprise a high pressure turbine and a low pressure turbine to drive a high pressure compressor in the compressor section 16 and a booster compressor and a fan in the fan section 14 respectively.

The fan section 14 comprises a fan rotor 24 which carries a plurality of equi-angularly spaced radially outwardly extending fan blades 26. The fan blades 26 are surrounded by a fan casing 28 which defines a bypass, or fan duct 29. The fan casing 28 is secured to the core casing 31 by a plurality of radially inwardly extending fan outlet guide vanes 30. The bypass duct 29 has a fan exhaust 32. The turbofan gas turbine engine 10 operates quite conventionally.

The fan blades 26 are shown more clearly in FIGS. 2 to 6. Each fan blade 26 comprises an aerofoil portion 32, a shank portion 34 and a root portion 36. The root portion 36 is preferably a dovetail root, but a firtree root or other type of root may be used. The aerofoil portion 32 has a leading end 38, a trailing end 40, a concave surface 42 and a convex surface 44. The concave surface 42 and the convex surface 44 extend from the leading end 38 to the trailing end 40 of the aerofoil portion 32 of the fan blade 26.

Figure 3:
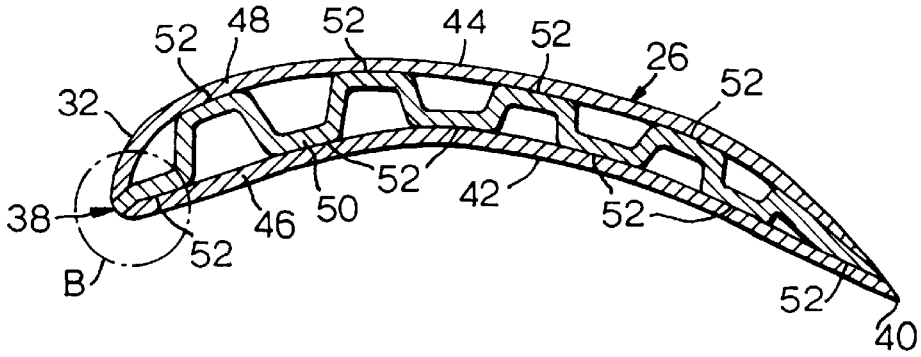
FIG. 3 is a cross-sectional view in the direction of line A—A in FIG. 2.
Figure 4:
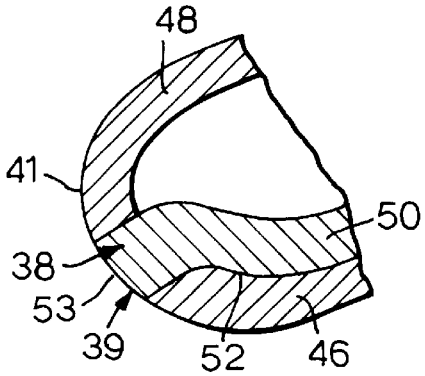
FIG. 4 is an enlarged view of the leading edge portion B of the fan blade shown in FIG. 3.

Each fan blade 26 preferably has a wide chord, but may have a conventional chord. Each fan blade 26 comprises at least three metallic sheets, or workpieces, 46, 48 and 50. At least one of the metallic sheets 50 has been superplastically formed into a corrugated, or warren girder, structure between the other two metallic sheets 46 and 48 and the at least one metallic sheet 50 is diffusion bonded at regions 52 to the other metallic sheets 46 and 48, as shown in FIG. 3.

The metallic sheet 46 defines the concave surface 42 of the aerofoil portion 32 of the fan blade 26 and the metallic sheet 48 defines the convex surface 44 of the aerofoil portion 32 of the fan blade 26.

As mentioned previously the leading end 38 of the aerofoil portion 32 of the fan blade 26 suffers from erosion due to foreign objects, for example grit, sand and other objects drawn into the intake 12 of the gas turbine engine 10, impacting the leading end 38 of the aerofoil portion 32 of the fan blade 26. The erosion of the leading end 38 of the aerofoil portion 32 of the fan blade 26 results in the leading end 38 becoming blunt. The blunting of the leading end 38 of the aerofoil portion 32 of the fan blade 26 results in a loss of efficiency of the fan blade 26.

In the present invention the blunting of the leading end 38 of the aerofoil portion 32 of the fan blade 26 is at least reduced. The leading end 38 of the aerofoil portion 32 is shown more clearly in FIG. 4. The leading end 38 of the aerofoil portion 32 comprises a leading edge 39 arranged between first and second leading end portions 37 and 41 respectively. The first leading end portion 37 is arranged on the concave surface 42 side of the aerofoil portion 32 and the second leading end portion 41 is arranged on the convex surface 44 side of the aerofoil portion 32. The leading edge 39 is formed of a harder material than the material of the first and second leading end portions 37 and 41. The upstream end 53 of the metallic sheet 50 is arranged to extend up to the leading end 38 of the aerofoil portion 32 and to actually define the leading end 39. The upstream ends of the metallic sheets 46 and 48 form the leading end portions 37 and 41 respectively. The metallic sheet 50 comprises a harder metal, or alloy, than the metallic sheets 46 and 48 and the metallic sheet 50 comprises a metal, or alloy, that is superplastically formable and diffusion bondable to the metallic sheets 46 and 48. Thus the metallic sheets 46 and 48 are preferably one titanium alloy and the metallic sheet 50 is a harder titanium alloy which is superplastically formable and diffusion bondable.

For example the metallic sheet 50 comprises a titanium alloy comprising 6 wt % aluminium, 2 wt % tin, 4 wt % zirconium, 6 wt % molybdenum and the balance titanium plus incidental impurities or a titanium alloy comprising 4 wt % aluminium, 4 wt % molybdenum, 2 wt % tin, 0.5 wt % silicon and the balance titanium plus incidental impurities or a titanium alloy comprising 4–5 wt % aluminium, 2–3.5 wt % vanadium, 1.8–2.2 wt % molybdenum, 1.7–2.3 wt % iron, up to 0.15 wt % oxygen and the balance titanium plus incidental impurities. The metallic sheets 46 and 48 comprise a titanium alloy comprising 6 wt % aluminium, 4 wt % vanadium and the balance titanium plus incidental impurities. Alternatively the metallic sheets 46 and 48 are one titanium alloy and the metallic sheet is another alloy which is superplastically formable and diffusion bondable.

This use of a metallic sheet 50 which is harder than the other metallic sheets 46 and 48 results in the leading end potions 37 and 41 at the upstream ends of the metallic sheets 46 and 48 respectively being eroded at a greater rate than the leading edge 39 at the upstream end of the metallic sheet 50 and because the upstream portion 52 of the metallic sheet 50 is at the leading end 38 of the aerofoil portion 32 of the fan blade 26 the leading end 38 retains, the relatively sharp shape, or taper from the leading end portions 37 and 41 to the leading edge 39 for a longer time and hence the fan blade 26 retains its efficiency for a longer time.

As an alternative to using different metals, or alloys, for the metallic sheets 46, 48 and 50, the metallic sheet 50 may be locally case hardened at its upstream end 52 for up to about 5 mm from its upstream end. The case hardening may be nitrogen gas impregnation, or other suitable process which does not effect the diffusion bonding process. In this case all three metallic sheets 46, 48 and 50 may comprise a titanium alloy comprising 6 wt % aluminium, 4 wt % vanadium and the balance titanium plus incidental impurities.

Figure 5:
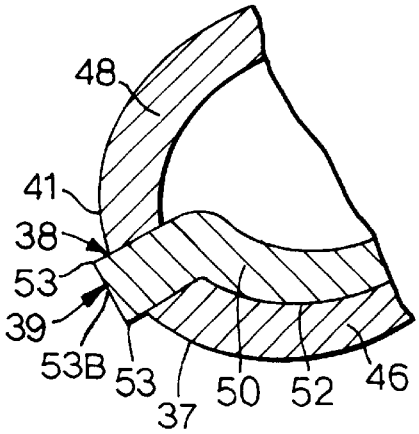
FIG. 5 is an alternative enlarged view of the leading edge portion B of the fan blade shown in FIG. 3.

In FIG. 5 the upstream end 53B of the metallic sheet 50 extends proud of the metallic sheets 46 and 48 by a distance substantially the same as the thickness of the metallic sheet 50. This arrangement may improve the aerodynamic efficiency of the leading end 38 because the corners 53 of the upstream end 53B of the metallic sheet 50 are eroded and the metallic sheets 46 and 48 are eroded along a locus generated from the harder metallic sheet 50, after a certain time, to form a taper from the first and second end portions 37 and 41 to the leading edge 39 to increase efficiency and achieve a more consistent fan blade 26 performance over a long time period.

Figure 6:
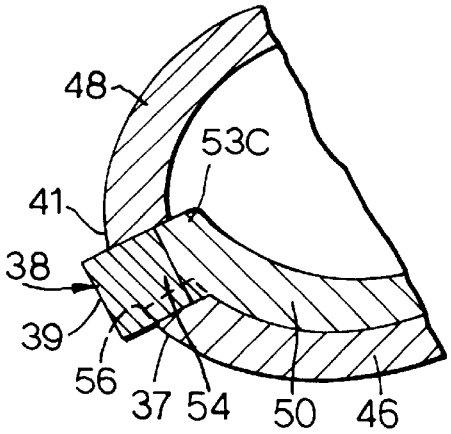
FIG. 6 is a further enlarged view of the leading edge portion B of the fan blade shown in FIG. 3.

In FIG. 6 the upstream end 53C does not extend to the leading end 38, and the metallic sheets 46, 48 and 50 comprise the same metal, or alloy. Another metallic member 54 is arranged between the upstream ends of the metallic sheets 46 and 48 at the leading end 38 of the aerofoil portion 32 of the fan blade 26. The upstream portion 56 of the metallic member 54 extends proud of the first and second leading end portions 37 and 41 of the upstream ends of the metallic sheets 46 and 48, but it may be flush. The metallic member 54 comprises a harder metal, or alloy, than the metallic sheets 46, 48 and 50. The metallic member 54 is diffusion bonded to the metallic sheets 46 and 48. The metallic sheets 46, 48 and 50 may comprise a titanium alloy comprising 6 wt % aluminium, 4 wt % vanadium and the balance titanium plus incidental impurities. The metallic member 54 may comprise a titanium alloy comprising 15 wt % vanadium, 3 wt % chromium, 3 wt % tin, 3 wt % aluminium and the balance titanium plus incidental impurities or a titanium alloy comprising 8 wt % vanadium, 3 wt % aluminium, 6 wt % chromium, 4 wt % molybdenum, 4 wt % zirconium and the balance titanium plus incidental impurities or a titanium alloy comprising 6 wt % aluminium, 2 wt % tin, 4 wt % zirconium, 6 wt % molybdenum and the balance titanium plus incidental impurities or a titanium alloy comprising 4 wt % aluminium, 4 wt % molybdenum, 2 wt % tin, 0.5 wt % silicon and the balance titanium plus incidental impurities. The metallic member 54 may comprise a nickel, cobalt or steel alloy, however, a diffusion barrier layer, of for example niobium or tantalum, may be required between the titanium alloy and the metallic member 54.

This use of a metallic member 54 which is harder than the other metallic sheets 46 and 48 results in the metallic sheets 46 and 48 being eroded at a greater rate than the metallic member 54 and because the upstream portion 56 of the metallic member 54 is at the leading end 38 of the aerofoil portion 32 of the fan blade 26 the leading end 38 retains relatively sharp shape, or taper from the leading end portions 37 and 41 to the leading edge 39 for a longer time and hence the fan blade 26 retains its efficiency for a longer time.

Another advantage of the invention is that because the leading end 38 of the fan blade 26 remains relatively sharp for a longer time the better aerodynamic flow around the leading end 38 of the fan blade 26 reduces flutter, or vibration, of the fan blade 26.

Although the invention has been described with reference to fan blades the invention is equally applicable to compressor blades, compressor vanes, turbine blades or turbine vanes if they suffer from erosion at their leading end.

Although the invention has been described with reference to blades comprising at least three metallic sheets, it may be applicable to blades comprising two sheets or one piece blades.

In its simplest form the invention may simply comprise the placing of a harder metallic material at the leading end of the aerofoil portion of the blade. For example a slot may be machined down the leading end of the blade and a harder metallic material may be placed in, and secured to, the slot such that the harder metallic material lies flush with or extends proud from the adjacent surfaces. The harder metallic material may be secured in the slot by suitable processes for example welding, diffusion bonding, brazing etc or by mechanical connection.

Although the invention has referred to metallic blades the invention is also applicable to blades comprising other materials. Thus a harder material is required at the leading end to improve erosion resistance at the leading end to maintain efficiency of the blade.

We claim:

1. A gas turbine engine blade comprising an aerofoil portion having a convex surface, a concave surface, a leading end and a trailing end, the leading end comprising a leading edge arranged between a first leading end portion and a second leading end portion, the first leading end portion being arranged on the convex surface side of the aerofoil portion and the second leading end portion being arranged on the concave surface side of the aerofoil portion, the leading edge being formed of a harder material than the material of the first and second leading end portions such that the leading end of the aerofoil portion retains a taper from the first and second leading end portions to a relatively sharp leading edge.

2. A blade as claimed in claim 1 wherein the blade is a fan blade or a compressor blade.

3. A gas turbine engine comprising a blade as claimed in claim 1.

4. A gas turbine engine blade comprising an aerofoil portion having a convex surface, a concave surface, a leading end and a trailing end, the leading end comprising a leading edge arranged between a first leading end portion and a second leading end portion, the first leading end portion being arranged on the convex surface side of the aerofoil portion and the second leading end portion being arranged on the concave surface side of the aerofoil portion, the leading edge being formed of a harder material than the material of the first and second leading end portions such that the leading end of the aerofoil portion retains a taper from the first and second leading end portions to a relatively sharp leading edge, wherein the blade is one of a fan blade and a compressor blade, the fan blade comprising at least three sheets diffusion bonded together, at least one of the sheets defining the convex surface, at least one of the sheets the concave surface and at least one of the sheets forming a corrugated structure between the convex surface and the concave surface and extending to the leading end of the aerofoil portion.

5. A blade as claimed in claim 4 wherein the at least one sheet forming the corrugated structure between the convex surface and the concave surface and extending to the leading end of the aerofoil portion is formed of a harder material than the at least one sheet defining the convex surface and the at least one sheet defining the concave surface.

6. A blade as claimed in claim 5 wherein the at least one sheet forming the corrugated structure between the convex surface and the concave surface and extending to the leading end of the aerofoil portion being formed of a harder alloy than the at least one sheet defining the convex surface and the at least one sheet defining the concave surface, the at least one sheet defining the convex surface and the at least one sheet defining the concave surface being formed of titanium alloy.

7. A blade as claimed in claim 4 wherein the at least three sheets are formed of titanium alloy.

8. A blade as claimed in claim 7 wherein the at least one sheet forming the corrugated structure between the convex surface and the concave surface and extending to the leading end of the aerofoil portion is formed of a harder titanium alloy than the at least one sheet defining the convex surface and the at least one sheet defining the concave surface.

9. A blade as claimed in claim 7 wherein the at least three sheets are formed of the same titanium alloy, the at least one sheet forming the corrugated structure between the convex surface and the concave surface and extending to the leading end of the aerofoil portion being formed of a hardened titanium alloy and the at least one sheet defining the convex surface and the at least one sheet defining the concave surface being formed of unhardened titanium alloy.

10. A blade as claimed in claim 4 wherein a strip of material is positioned between the at least one sheet forming the convex surface and the at least one sheet forming the concave surface, the strip of material being formed of a harder material than the at least three sheets.

11. A blade as claimed in claim 3 wherein a strip of material is positioned at the leading end of the aerofoil portion, the strip of material being formed of a harder material than the first and second leading end portions.

12. A blade as claimed in claim 11 wherein the strip of material extends beyond the leading end of the aerofoil.

13. A blade as claimed in claim 11 wherein the strip of material is located in a slot at the leading end of the blade.

14. A blade as claimed in claim 13 wherein the strip of material is welded in the slot.

15. A blade as claimed in claim 13 wherein the strip of material is diffusion bonded in the slot.

16. A blade as claimed in claim 13 wherein the strip of material is brazed in the slot.

17. A blade as claimed in claim 4 wherein the at least one sheet forming the corrugated structure between the convex surface and the concave surface and extending to the leading end of the aerofoil portion extending beyond the at least one sheet defining the convex surface and the at least one sheet defining the concave surface.

* * * * *